US006481116B1

(12) United States Patent
Slingo

(10) Patent No.: US 6,481,116 B1
(45) Date of Patent: Nov. 19, 2002

(54) HAIR DRYER EMPLOYING FAR-INFRARED RADIATION

(76) Inventor: Fred M. Slingo, c/o 21st Century Innovative Products, L.L.C. 905 Armstrong St., Algonquin, IL (US) 60102

( * ) Notice: Subject to any disclaimer, the term of this patent is extended or adjusted under 35 U.S.C. 154(b) by 0 days.

(21) Appl. No.: 09/837,688

(22) Filed: Apr. 18, 2001

Related U.S. Application Data

(63) Continuation-in-part of application No. 09/824,066, filed on Apr. 2, 2001.

(51) Int. Cl.[7] ..... A45D 20/00

(52) U.S. Cl. ..... 34/97; 34/269; 34/90; 392/375; 392/385

(58) Field of Search ..... 34/90, 96, 97, 34/98, 99, 266, 267, 269; 392/375, 379, 380, 381, 382, 383, 384, 385

(56) References Cited

U.S. PATENT DOCUMENTS 4,316,077 A * 2/1982 Carlson ..... 219/370
4,636,617 A * 1/1987 Petersen et al. ..... 219/375
4,757,183 A * 7/1988 Karey et al. ..... 219/365
5,077,461 A * 12/1991 Hasegawa ..... 219/553
5,996,243 A * 12/1999 Chang et al. ..... 34/97
6,205,677 B1 3/2001 Yune

* cited by examiner

*Primary Examiner*—Ira S. Lazarus
*Assistant Examiner*—Kathryn S. O'Malley
(74) *Attorney, Agent, or Firm*—Bell, Boyd & Lloyd LLC

(57) ABSTRACT

A hair dryer employing a radiator made of a ceramic adapted when heated to radiate far-infrared radiation comprises an elongate body, which has an inlet end defining an inlet and an outlet end defining an outlet, a fan, which is adapted when driven to draw air into the inlet, to move air through the elongate body, and to blow air from the outlet, an electrical motor, which is adapted when energized to drive the fan, and an electrical heater, which is mounted within the elongate body, between the fan and the outlet. The ceramic radiator is configured as a grille having plural apertures, through which air can flow when moved through the elongate body by the fan when energized. As and where a flow modifier, such as a flow concentrator, would be otherwise mounted, the ceramic radiator is mounted to the elongate body, at or near the outlet end, within the outlet, via a generally tubular adapter. The ceramic radiator is mounted so as to be radiantly heated by the electrical heater when energized and so as to be additionally heated by air being moved through the elongate body by the fan when the electrical motor is energized and being heated by the electrical heater when the electrical heater is energized.

10 Claims, 1 Drawing Sheet

HAIR DRYER EMPLOYING FAR-INFRARED RADIATION

CROSS-REFERENCE TO RELATED APPLICATION

This application is a continuation-in-part of U.S. patent application Ser. No. 09/824,066, which was filed on Apr. 2, 2001, and the disclosure of which is incorporated herein by reference.

FIELD OF THE INVENTION

This invention pertains to a hair dryer employing a radiator made of a ceramic adapted when heated to radiate far-infrared radiation.

BACKGROUND OF THE INVENTION

Conventionally, a hair dryer employs a heating wire, such as a nickel-chromium (Ni—Cr) wire, and relies upon heat convection only to dry a user's hair.

As exemplified in U.S. Pat. No. 6,205,677 (from International Application No. PCT/KR99/00336) it has been known for a hair dryer to employ a heater radiating far-infrared radiation. As exemplified therein, the heater radiating far-infrared radiation is a halogen heater, which comprises a heating wire within a gas-filled, quartz tube. Such a hair dryer employs far-infrared radiation as well as heat convection to dry a user's hair.

Certain ceramics containing silica oxide ($SiO_2$) and aluminum oxide ($AL_2O_2$) are known to radiate far-infrared radiation when heated. In some publications, because of biological and physiological effects attributed to farinfrared radiation by researchers in Japan, Korea, and elsewhere, such ceramics that radiate far-infrared radiation are called bio-ceramics. Also, in some publications, far-infrared radiation is called by a "FIR" acronym.

Hereinbefore and hereinafter, although far-infrared radiation refers to a much wider range in astronomy and astrophysics, far-infrared radiation refers to electromagnetic radiation having a wave length in a range from approximately five microns to approximately fifteen microns.

SUMMARY OF THE INVENTION

This invention provides a hair dryer employing a radiator made of a ceramic, such as a bio-ceramic, which is adapted when heated to radiate farinfrared radiation. A ceramic suitable for the radiator is available commercially from Tae Yang Ind. Co. of Majungong 87-1, Sugu, Inchon, Korea, under its CELAMINE trademark.

The hair dryer comprises an elongate body, which has an inlet end defining an inlet and an outlet end defining an outlet. The hair dryer further comprises a fan, which is adapted when driven to draw air into the inlet, to move air through the elongate body, and to blow air from the outlet, and an electrical motor, which is adapted when energized to drive the fan. The hair dryer further comprises an electrical heater, which is mounted within the elongate body, between the fan and the outlet.

This invention contemplates that the ceramic radiator is mounted to the elongate body, at or near the outlet end, so as to be radiantly heated by the electrical heater when energized and so as to be additionally heated by air being moved through the elongate body by the fan when the electrical motor is energized and being heated by the electrical heater when the electrical heater is energized.

Preferably, the elongate body, at or near the outlet end, and the ceramic radiator have respective formations, which enable the ceramic radiator to be snapfitted onto the elongate body, at or near the outlet end. In a preferred embodiment, such formations enable the ceramic radiator to be snap fitted onto the elongate body, at or near the outlet end, within the outlet. Preferably, the electric heater is configured as a grille having plural apertures, through which air can flow when moved through the elongate body by the fan when energized.

For a discussion of certain effects attributed to far-infrared radiation, particularly in a context of a hair dryer, the disclosure of U.S. Pat. No. 6,205,677, supra, is incorporated herein by reference.

DETAILED DESCRIPTION OF THE PREFERRED EMBODIMENT

Figure 1:
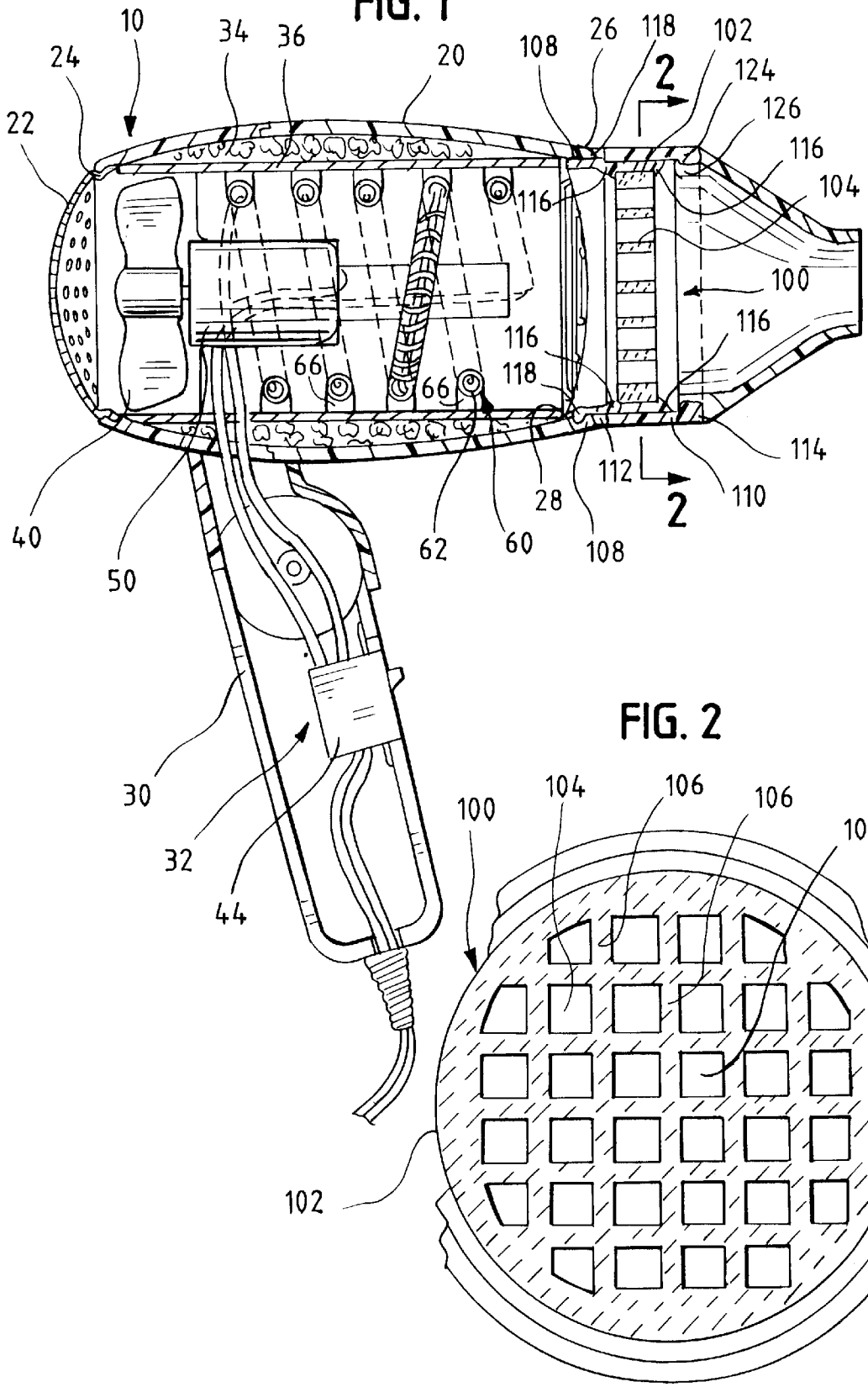
FIG. 1 is a longitudinal, cross-sectional view of a hair dryer employing a ceramic radiator, as discussed above, and constituting a preferred embodiment of this invention.
Figure 2:
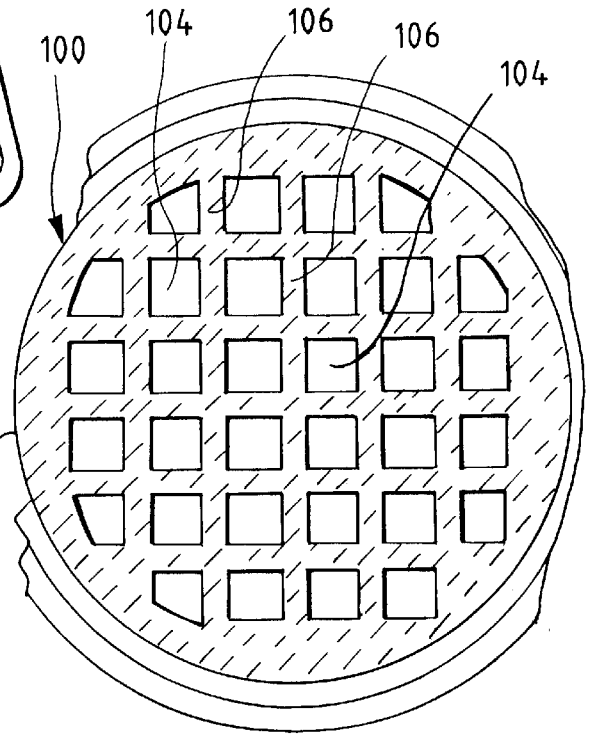
FIG. 2 is a transverse, cross-sectional view taken along line 2—2 of FIG. 1, in a direction indicated by arrows.

As shown, a hair dryer 10 employing a ceramic radiator 100, as discussed above, constitutes a preferred embodiment of this invention. When heated in a manner to be later described, the ceramic radiator 100 radiates far-infrared radiation, i.e., electromagnetic radiation having a wave length in a range from approximately five microns to approximately fifteen microns.

The hair dryer 10 comprises an elongate body 20, which has an inlet end 22 defining an inlet 24 and an outlet end 26 defining an outlet 28 and which has an attached handle 30 mounting an electrical switching means 32. The elongate body 20 is lined with thermally insulative materials 34, 36, of types used conventionally in hair dryers.

The hair dryer 10 further comprises a fan 40, which is adapted when driven to draw air into the inlet 24, to move air through the elongate body 20, and to blow air from the outlet 28, and an electrical motor 50, which is adapted when energized to drive the fan 40 via a rotary shaft 42. The hair dryer 10 further comprises an electrical heater 60, which is mounted within the elongate body 20, between the fan 40 and the outlet 28 and which comprises an elongate coil 62 of a heating wire, such as a nickel-chromium (Ni—Cr) wire. The elongate coil 62 is mounted within the elongate body 20 via mounting tabs 66.

The fan 40 and the electrical heater 60 are controlled by the electrical switching means 32, through which the fan 40 and the electrical heater 60 are connectable to a source (not shown) of electrical power. The electrical switching means 32 may comprise a single switch 44 to control the fan 40 and to control the electrical heater 60 or, if desired, a separate switch (not shown) to control the fan 40 and a separate switch (not shown) to control the electrical heater 60. The fan 40 and the electrical heater 60 may be thus controlled at a single setting for each or at plural, selectable settings for one or for both.

As mounted to the elongate body 20, at the outlet end 26, the ceramic radiator 100 is configured as a grille having an outer, generally cylindrical edge 102 and having plural apertures 104, which are defined by crossed members 106 and through which air can flow when moved through the elongate body 20 by the fan 40 when energized.

A generally tubular adapter 110 having an inner end 112, an outer end 114, and two circumferential, radially inwardly projecting ribs 116 is provided, in which the ceramic radiator 100 is mounted, between the ribs 116. The elongate body 20, at the outlet end 26, and the generally tubular adapter 110, at the inner end 112, have respective formations 108, 118, which enable the generally tubular adapter 110 to be snap-fitted onto the elongate body 20, at the outer end 26, within the outlet 28, whereby to mount the ceramic radiator 100 onto the elongate body 20, at the outlet end 28.

Being mounted to the elongate body 20, at the outlet end 26, as described above, the ceramic radiator 100 is mounted so as to be radiantly heated by the electrical heater 60 when the electrical heater 60 is energized and so as to be additionally heated by air being moved through the elongate body 20 by the fan 40 when the electrical motor 50 is energized and being heated by the electrical heater 60 when the electrical heater 60 is energized.

A flow modifier 120, at an inner end 122, and the generally tubular adaptor 110, at the inner end 112, have similar formations 124, 126, which enable the flow concentrator 120 to be snap-fitted onto the generally tubular adapter 110. If the ceramic radiator 100 and the tubular adapter 110 were not provided, the flow concentrator 120 could be snap-fitted onto the elongate body 20, at the outer end 26, within the outlet 28. As shown, the flow modifier 120 is a flow concentrator of a known type, which is provided commonly on a hair dryer. Alternatively, the flow modifier could be a flow diffuser (not shown) of a known type, which is provided commonly on a hair dryer.

Broadly, as the generally tubular adapter 100 is mountable as and where the flow modifier 120 would be otherwise mounted, this invention enables a ceramic radiator, such as the ceramic radiator 100, to be readily adapted for any hair dryer having an elongate body with suitable formations enabling a flow concentrator or a flow diffuser to be snap fitted onto the elongate body, at or near an outlet end of the elongate body.

As compared to known hair dryers relying upon heat convection only, the hair dryer 10 can be effectively operated at lower temperatures and with higher efficiencies.

What is claimed is:

1. A hair dryer employing a radiator made of a ceramic adapted when heated to radiate far-infrared radiation, the hair dryer comprising an elongate body, which has an inlet end defining an inlet and an outlet end defining an outlet, a fan, which is adapted when driven to draw air into the inlet, to move air through the elongate body, and to blow air from the outlet, an electrical motor, which is adapted when energized to drive the fan, and an electrical heater, which is mounted within the elongate body, between the fan and the outlet, the ceramic radiator being mounted to the elongate body, at the outlet end, so as to be radiantly heated by the electrical heater when energized and so as to be additionally heated by air being moved through the elongate body by the fan when the electrical motor is energized and being heated by the, electrical heater when the electrical heater is energized.

2. The hair dryer of claim 1 wherein the ceramic radiator has an outer, generally cylindrical edge, wherein the hair dryer further comprises a generally tubular adapter, in which the ceramic radiator is mounted, and wherein the elongate body, at the outlet end, and the generally tubular adapter have respective formations, which are adapted to be snap-fitted together so as to mount the ceramic radiator onto the elongate body, at or near the outlet end.

3. The hair dryer of claim 1 wherein the ceramic radiator has an outer, generally cylindrical edge, wherein the hair dryer further comprises a generally tubular adapter, in which the ceramic radiator is mounted, and wherein the elongate body, at the outlet end, and the generally tubular adapter have respective formations, which are adapted to be snap-fitted together so as to mount the ceramic radiator onto the elongate body, at or near the outlet end, within the outlet.

4. The hair dryer of claim 1 wherein the ceramic radiator is configured as a grille having plural apertures, through which air can flow when moved through the elongate body by the fan when energized.

5. The hair dryer of claim 2 wherein the ceramic radiator is configured as a grille having plural apertures, through which air can flow when moved through the elongate body by the fan when energized.

6. The hair dryer of claim 3 wherein the ceramic radiator is configured as a grille having plural apertures, through which air can flow when moved through the elongate body by the fan when energized.

7. A hair dryer employing a radiator made of a ceramic adapted when heated to radiate far-infrared radiation, the hair dryer comprising an elongate body, which has an inlet end defining an inlet and an outlet end defining an outlet, a fan, which is adapted when driven to draw air into the inlet, to move air through the elongate body, and to blow air from the outlet, an electrical motor, which is adapted when energized to drive the fan, and an electrical heater, which is mounted within the elongate body, between the fan and the outlet, the ceramic radiator being mounted to the elongate body, near the outlet end, so as to be radiantly heated by the electrical heater when energized and so as to be additionally heated by the air being moved through the elongate body by the fan when the electrical motor is energized and being heated by the electrical heater when the electrical heater is energized.

8. The hair dryer of claim 7 wherein the ceramic radiator is configured as a grille having plural apertures, through which air can flow when moved through the elongate body by the fan when energized.

9. The dryer of claim 7 wherein the ceramic radiator is mounted near the outlet end, within the elongate body.

10. The dryer of claim 9 wherein the ceramic radiator is configured as a grille having plural apertures, through which air can flow when moved through the elongate body by the fan when energized.

* * * * *